US009466953B2

(12) United States Patent
Burrows et al.

(10) Patent No.: US 9,466,953 B2
(45) Date of Patent: Oct. 11, 2016

(54) INTRA-EVENT CONTROL STRATEGY FOR CORONA IGNITION SYSTEMS

(71) Applicant: Federal-Mogul Ignition Company, Southfield, MI (US)

(72) Inventors: John Antony Burrows, Cheshire (GB); John E. Miller, Temperance, MI (US); Kristapher I. Mixell, Plymouth, MI (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 280 days.

(21) Appl. No.: 14/138,228

(22) Filed: Dec. 23, 2013

(65) Prior Publication Data

US 2014/0174392 A1 Jun. 26, 2014

Related U.S. Application Data

(60) Provisional application No. 61/740,781, filed on Dec. 21, 2012, provisional application No. 61/740,796, filed on Dec. 21, 2012.

(51) Int. Cl.
*F02P 23/00* (2006.01)
*H01T 19/00* (2006.01)
(Continued)

(52) U.S. Cl.
CPC ..... *H01T 19/00* (2013.01); *F02P 19/02* (2013.01); *F02P 23/04* (2013.01)

(58) Field of Classification Search
CPC ..... H01T 19/00; F02P 23/04; F02P 19/02
USPC ..... 123/143 R, 143 B; 701/102, 113; 324/600, 633, 678
See application file for complete search history.

(56) References Cited

U.S. PATENT DOCUMENTS 4,423,461 A * 12/1983 Kaainoa ..... H02M 5/4505 361/235
4,794,254 A * 12/1988 Genovese ..... H01T 19/00 250/324

(Continued)

FOREIGN PATENT DOCUMENTS

AU 5568801 A 11/2001
DE 102010044845 B3 12/2011

OTHER PUBLICATIONS

International Search Report mailed on Feb. 26, 2014 (PCT/US2013/077365).

*Primary Examiner* — Joseph Dallo
(74) *Attorney, Agent, or Firm* — Robert L Stearns; Dickinson Wright, PLLC

(57) ABSTRACT

The invention provides a system and method for controlling corona discharge and arc formations during a single corona event, i.e. intra-event control. A driver circuit provides energy to the corona igniter and detects any arc formation. In response to each arc formation, the energy provided to the corona igniter is shut off for short time. The driver circuit also obtains information about the arc formations, such as timing of the first arc formation and number of occurrences. A control unit then adjusts the energy provided to the corona igniter after the shut off time and during the same corona event based on the information about the arc formations. For example, the voltage level could be reduced or the shut-off time could be increased to limit arc formations and increase the size of the corona discharge during the same corona event.

10 Claims, 9 Drawing Sheets

(51) Int. Cl.
*F02P 19/02* (2006.01)
*F02P 23/04* (2006.01)

(56) References Cited

U.S. PATENT DOCUMENTS

| | | | | |
|---|---|---|---|---|
| 4,996,967 | A | 3/1991 | Rosswurm et al. | |
| 5,649,507 | A | 7/1997 | Gregoire et al. | |
| 6,085,733 | A | 7/2000 | Motoyama et al. | |
| 6,883,507 | B2 | 4/2005 | Freen | |
| 7,644,698 | B2 | 1/2010 | Shiraishi et al. | |
| 7,721,697 | B2 | 5/2010 | Smith et al. | |
| 2010/0147239 | A1 | 6/2010 | Lu et al. | |
| 2010/0251995 | A1 | 10/2010 | Nouvel et al. | |
| 2011/0114071 | A1 | 5/2011 | Freen | |
| 2011/0197865 | A1 | 8/2011 | Hampton | |
| 2011/0297132 | A1 | 12/2011 | Schremmer et al. | |
| 2011/0305998 | A1 | 12/2011 | Toedter et al. | |
| 2012/0048225 | A1 | 3/2012 | Makarov et al. | |
| 2012/0055455 | A1 | 3/2012 | Ruan et al. | |
| 2012/0063054 | A1 | 3/2012 | Burrows et al. | |
| 2012/0145136 | A1 | 6/2012 | Burrows et al. | |
| 2012/0180742 | A1* | 7/2012 | Burrows | F02P 9/007 123/143 B |
| 2012/0192825 | A1 | 8/2012 | Trump | |
| 2012/0249006 | A1 | 10/2012 | Burrows | |
| 2012/0249163 | A1* | 10/2012 | Burrows | F02P 23/04 324/633 |
| 2012/0260898 | A1 | 10/2012 | Schremmer | |
| 2013/0199508 | A1* | 8/2013 | Toedter | F02P 23/04 123/594 |
| 2014/0182538 | A1* | 7/2014 | Burrows | F02P 23/04 123/143 B |
| 2015/0171602 | A1* | 6/2015 | Burrows | G01M 15/02 361/230 |

* cited by examiner

INTRA-EVENT CONTROL STRATEGY FOR CORONA IGNITION SYSTEMS

CROSS REFERENCE TO RELATED APPLICATIONS

This U.S. utility patent application claims the benefit of U.S. provisional patent application No. 61/740,781, filed Dec. 21, 2012, and U.S. provisional patent application No. 61/740,796, filed Dec. 21, 2012, the entire contents of which are incorporated herein by reference in their entirety.

BACKGROUND OF THE INVENTION

1. Field of the Invention

This invention relates generally to a corona ignition system, and a method of controlling corona discharge and arc formation provided by the corona ignition system.

2. Related Art

Corona discharge ignition systems provide an alternating voltage and current, reversing high and low potential electrodes in rapid succession. These systems include a corona igniter with an electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. During typical operation of the corona ignition system, the electric field is ideally controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. The corona discharge has a low current and can provide a robust ignition without requiring a high amount of energy and without causing significant wear to physical components of the ignition system.

In a corona ignition system, good ignition characteristics are due to the corona discharge spreading over a large volume in a large number of filaments or streamers. If too much energy is applied to the corona igniter, it is possible for the corona discharge to extend from the high voltage source far enough to reach a grounded engine component. When this happens, a conductive path, referred to as an arc, is formed to the grounded component. The arc formation comprises a relatively high current flow and thus concentrates the ignition energy into a very limited volume, reducing ignition efficiency. It is typically desirable to avoid this situation. Conversely, it is difficult to be certain that a corona igniter is fed with enough energy to produce a large enough corona, as there is no direct method of obtaining the volume of the corona discharge.

SUMMARY OF THE INVENTION

One aspect of the invention provides a corona ignition system for controlling the volume and duration of corona discharge during a single corona event, i.e. intra-event control. The corona event is a single continuous duration of time extending from a start time to a stop time. During the corona event, a corona igniter receives energy at a voltage level and a current level, and emits an electric field. A driver circuit provides the energy to the corona igniter during the corona. Immediately after any occurrence of arc formation, the driver circuit provides no energy to the corona igniter for a duration of time. The driver circuit also obtains information about the at least one occurrence of the arc formation. This information typically includes at least one of: timing of at least one occurrence of the arc formation relative to the start time of the corona event, duration between two consecutive occurrences of the arc formations, and number of occurrences of the arc formation over a period of time during the corona event. A control unit receives the information about the arc formation from the driver circuit and adjusts at least one of the voltage level and the current level based on the information about the arc formation. The driver circuit then provides an adjusted energy level to the corona igniter after the duration of time wherein no energy is provided to the corona igniter. The adjusted energy level includes at least one of the adjusted voltage level and the adjusted current level.

Alternatively, the control unit adjusts the duration of time wherein no energy is provided to the corona igniter after any arc formation is detected, based on the information about the arc formation detected. The driver circuit then applies this adjusted duration of time after a subsequent occurrence of the arc formation during the corona event. According to another embodiment, the control unit adjusts the stop time of the corona event based on the information about the arc formation.

Another aspect of the invention provides a method of controlling a corona ignition system. The method comprises the steps of: providing energy to the corona igniter during the corona event; providing no energy to the corona igniter for a duration of time immediately after any occurrence of an arc formation. The method further includes obtaining information about the arc formation. The information includes at least one of: timing of at least one occurrence of the arc formation relative to the start time of the corona event, duration between two consecutive occurrences of the arc formations, and number of occurrences of the arc formation over a period of time during the corona event. The method then includes adjusting at least one of the voltage level, the current level, the stop time of the corona event, and the duration of time wherein no energy is provided to the corona igniter based on the information about the arc formation. This adjusting step occurs during the same corona event.

Another aspect of the invention provides a method of controlling a corona discharge ignition system. The method includes providing energy to a corona igniter during a corona event; and providing the energy to the corona igniter at a voltage level and current level causing the corona igniter to provide corona discharge for a majority of the duration of the corona event. The voltage level and current level of the energy provided to the corona igniter also causes the corona igniter to provide at least one occurrence of the arc formation following the corona discharge before a predetermined stop time of the corona event.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
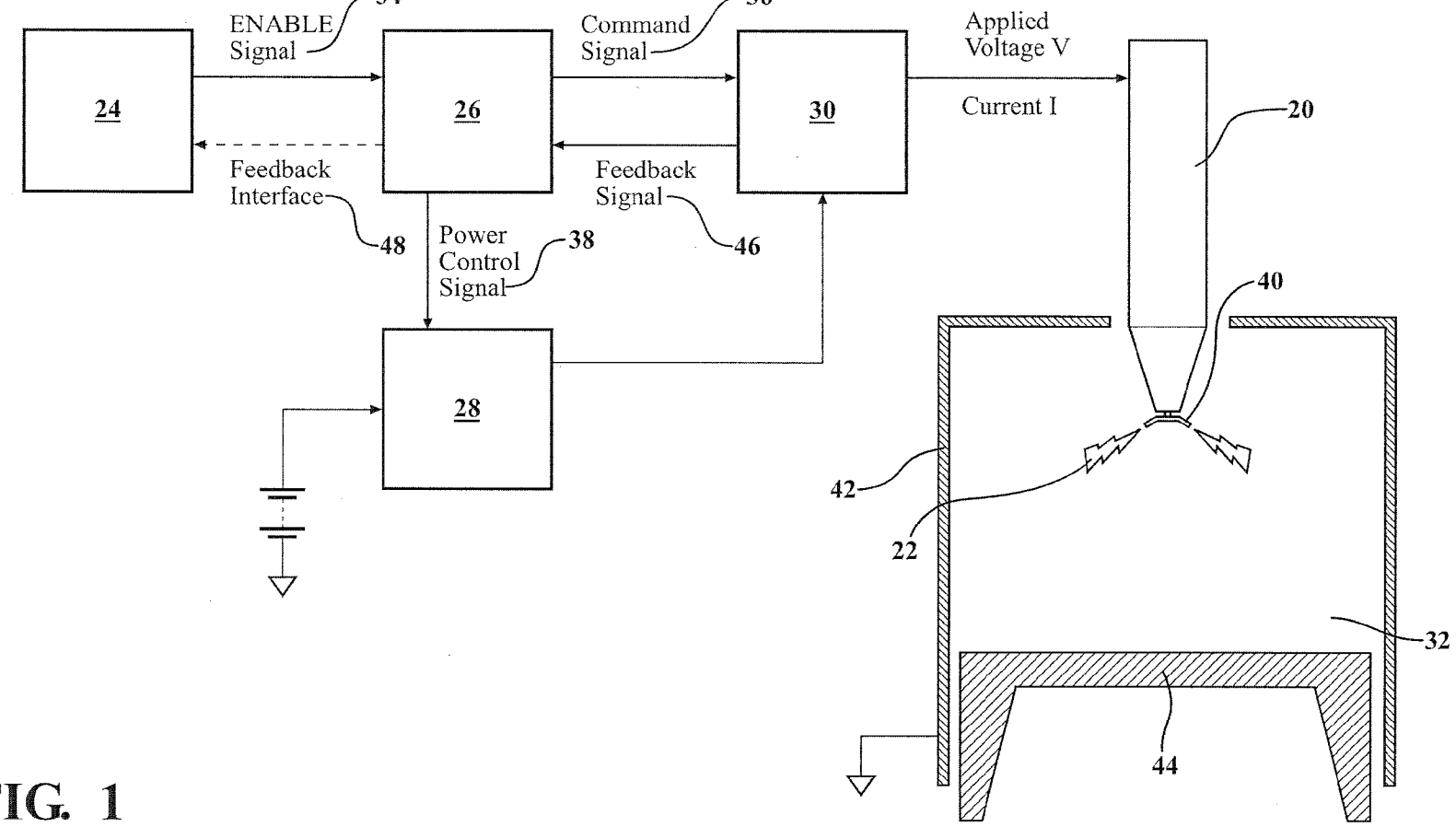
FIG. 1 is a block diagram showing hardware of a corona ignition system for controlling corona discharge and arc formation according to one embodiment of the invention.

One aspect of the invention provides a corona ignition system for an internal combustion engine. The system includes a corona igniter 20 providing corona discharge 22, an engine control system 24, a control unit 26, a power supply 28, and a driver circuit 30. An exemplary system is generally shown in FIG. 1. The energy provided from the power supply 28 to the corona igniter 20 is adjusted during a single corona event, i.e. on an intra-event basis, to enhance the size and duration of the corona discharge 22. Thus, the system is able to provide the maximum possible volume of corona discharge 22 under all operation conditions, and can be made stable for all operating conditions, including those where breakdown of the corona discharge 22 to arc formation is unavoidable.

The engine control system 24 initiates the start of the corona event in order to ignite a mixture of fuel and air in a combustion chamber 32 and power the internal combustion engine. The corona event is a single continuous duration of time extending from a start time to a stop time, during which the corona igniter 20 receives energy and provides the corona discharge 22. The duration of the corona event is typically predetermined and set as a function of engine operation parameters. Typically, the duration of the corona event ranges from 20 to 3,500 microseconds. The engine control system 24 starts the corona event at the start time by conveying an enable signal 34 to the control unit 26, which actives the control unit 26. In this example, the engine control system 24 also stops the corona event by conveying a signal to the control unit 26 at the stop time, which deactivates the control unit 26. In the embodiment of FIG. 1, the engine control system 24 is separate from the control unit 26, but alternatively the engine control system 24 can be combined with the control unit 26 in a single piece of hardware. Furthermore, the other components of the system could also be combined in various different manners.

In response to the enable signal 34, the control unit 26 turns on the driver circuit 30 by conveying a command signal 36 to the driver circuit 30. The control unit 26 also conveys a power control signal 38 to the power supply 28, instructing the power supply 28 to provide the energy to the driver circuit 30, which ultimately reaches the corona igniter 20, at a predetermined voltage level and a predetermined current level. Thus, the control unit 26 controls the energy provided to the corona igniter 20. In the exemplary system, the predetermine voltage level ranges from 100 to 1500 V and the predetermined current level ranges from 0.5 to 15 A. Ideally, the corona igniter 20 receives the high radio frequency voltage and current and provides a strong radio frequency electric field, i.e. the corona discharge 22, in the combustion chamber 32. In the system of FIG. 1, the corona igniter 20 includes a firing tip 40 for emitting the corona discharge 22.

The control unit 26 typically reads the predetermined voltage level and the predetermined current level from a table or map stored in the control unit 26 or the engine control system 24. Initially, the predetermined voltage level and the predetermined current level are typically based on engine parameters or operating conditions in the combustion chamber 32. However, these predetermined levels stored in the control unit 26 or engine control system 24 can optionally be adjusted based on information about a previous corona event, which will be discussed further below.

The driver circuit 30 receives the energy from the power supply 28 at the predetermined voltage level and the predetermined current level. In response to the command signal 36 from the control unit 26, the driver circuit 30 provides the energy to the corona igniter 20 at the predetermined voltage level and the predetermined current level. The corona igniter 20 receives the energy from the driver circuit 30, and emits the corona discharge 22. In an ideal situation, the corona discharge 22 would rapidly form in the combustion chamber 32, grow to a maximum volume, which is the largest possible volume without reaching a grounded component, and remain at the maximum volume until the end of the corona event. Thus, the corona discharge 22 would provide a high quality ignition by igniting a large volume of the air-fuel mixture in the combustion chamber 32.

However, at some point during the corona event, the corona igniter 20 typically receives too much energy, causing the corona discharge 22 grow too large and reach a grounded component, such as a wall 42 of the combustion chamber 32 or a piston 44 reciprocating in the combustion chamber 32. At this time, a conductive path, referred to as an arc formation, forms between the corona igniter 20 and the grounded component. In other words, the corona discharge 22 transforms into the arc formation. The corona discharge 22 is preferred over the arc formation because it has a lower current and spreads over a larger volume, and thus is able to provide a higher quality ignition of the fuel-air mixture.

Any occurrence of arc formation in the combustion chamber 32 is immediately detected by the driver circuit 30. An exemplary method used to detect the onset of the arc formation is described in U.S. patent application Ser. No. 13/438,116. This method does not rely on measuring current, voltage, or impedance parameters related to the corona discharge 22. Rather, the method detects the arc formation by identifying a variation in an oscillation period of the resonant frequency, and provides a positive detection in nanoseconds or microseconds, and typically less than 2 μs. Accordingly, it is an easily implemented method allowing for very rapid feedback indicating the occurrence of arc formation. However, other methods can be used to detect the arc formation. Also, although any occurrence of an arc formation during the corona event is detected, there is not necessary an arc formation detected during the corona event, as the corona event could occur without any arcing.

Figure 2:
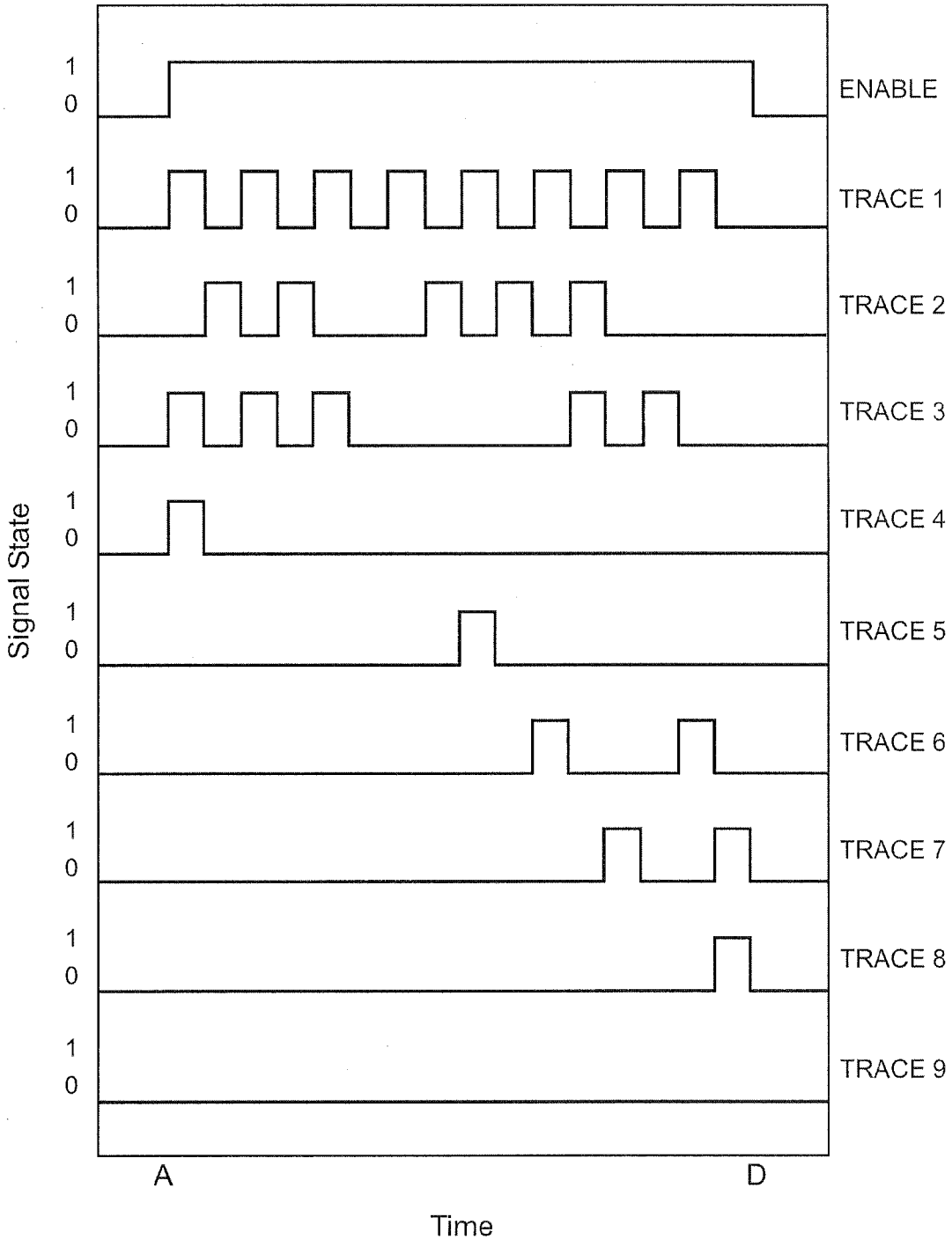
FIG. 2 is a graph illustrating nine exemplary feedback signals indicating the occurrence or absence of at least one arc formation during a single corona event relative to an enable signal starting and stopping the corona event.

When the driver circuit 30 detects the occurrence of the arc formation, the driver circuit 30 conveys a feedback signal 46 to the control unit 26 indicating the occurrence of the arc formation. FIG. 2 is a graph illustrating nine exemplary feedback signals 46 indicating one or multiple arc formations during a single corona event, relative to the enable signal 34 starting and stopping the corona event. In response to the feedback signal 46, the control unit 26 sends another command signal 36 to the driver circuit 30 instructing the driver circuit 30 to cease the energy provided to the corona igniter 20 for a short duration of time immediately after the occurrence of the arc formation. This duration of time is typically predetermined and stored in the control unit 26. Accordingly, once the arc formation is detected, the driver circuit 30 provides no energy to the corona igniter 20 for the duration of time, and thus the arc formation dissipates. In one embodiment, this duration ranges from ten to hundreds of microseconds.

An exemplary method used to shut off the energy provided to the corona igniter 20 for the short duration of time is described in U.S. patent application Ser. No. 13/438,127. Although nothing is done to prevent the first occurrence of the arc formation, upon the first detection, the system takes action to prevent future arc formations. In the exemplary method, the energy is immediately shut off in response to the arc formation, rather than reduced, because the voltage required to maintain the arc formation is much less than the voltage required to maintain the corona discharge 22, and thus reducing the voltage applied to the corona igniter 20 will most likely not dissipate the arc formation. The steps of detecting the occurrence of the arc formation and shutting off the energy are repeated throughout the corona event.

Upon detection of the arc formation, the driver circuit 30 also obtains information about the arc formation. This information is more than just a "yes or no" result, and the information is used to infer information about the volume and duration of the corona discharge 22. The information about the arc formation includes at least one of the following characteristics: timing of the occurrence of the arc formation relative to the start time of the corona event, duration between two consecutive occurrences of the arc formations, and number of occurrences of the arc formation over a period of time during the corona event.

Figure 3:
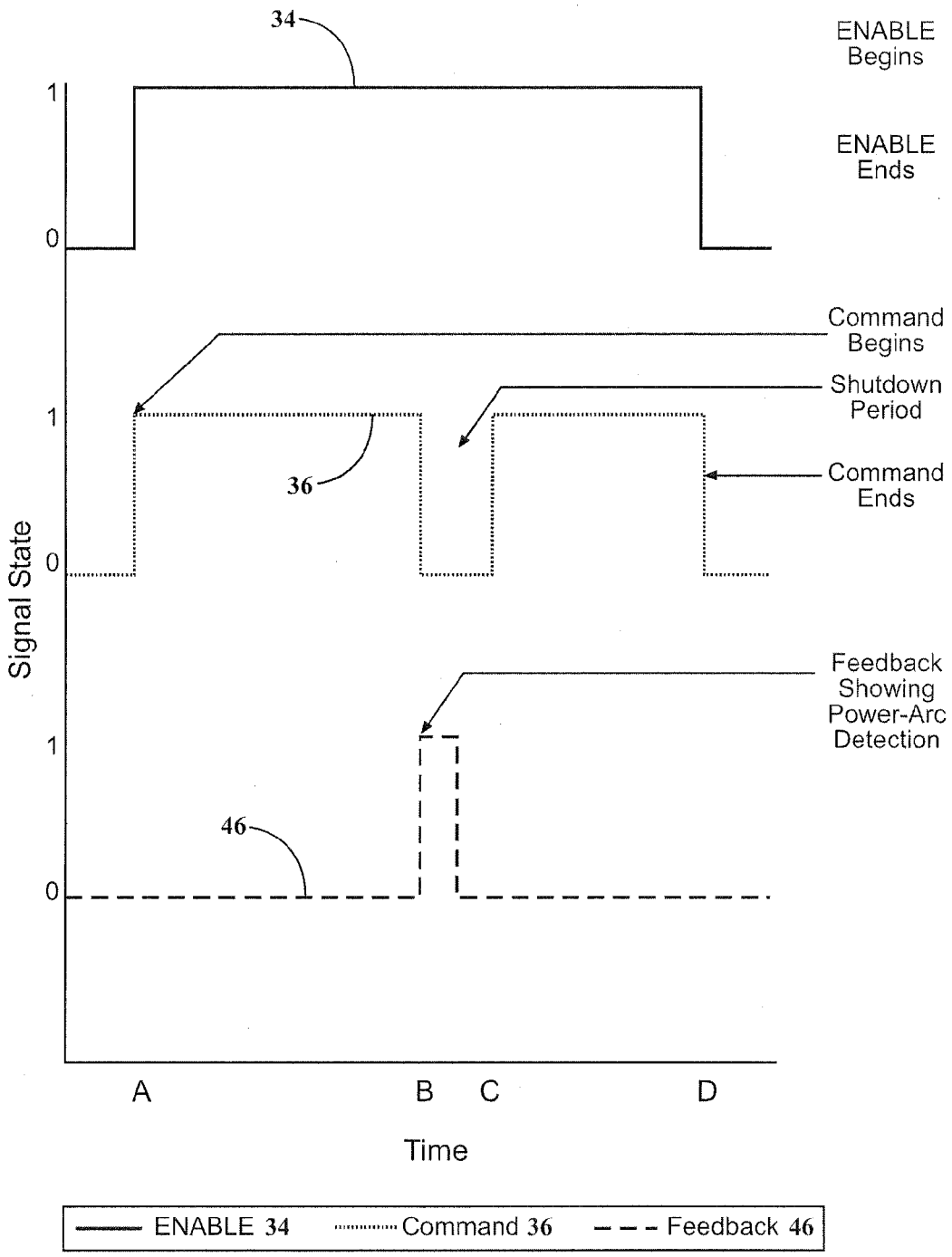
FIG. 3 is a graph illustrating a feedback signal, an enable signal, and a command signal when only one occurrence of arc formation is detected during a corona event.
Figure 4:
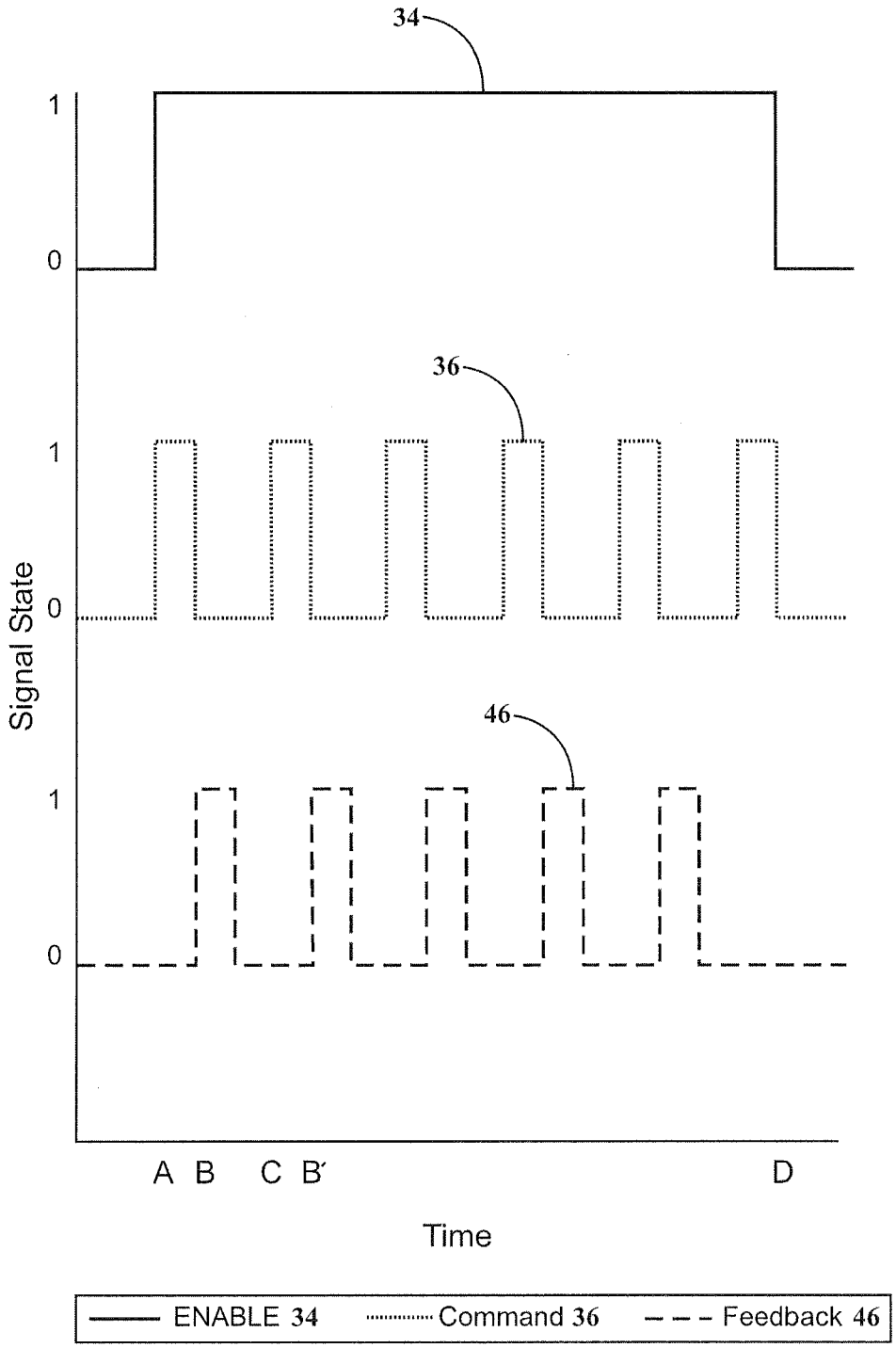
FIG. 4 is a graph illustrating a feedback signal, an enable signal, and a command signal when multiple occurrences of arc formation are detected in a corona event.

The driver circuit 30 then conveys the information about the arc formation in the feedback signal 46 to the control unit 26. This can be the same feedback signal 46 sent in response to the detection of the arc formation, or a separate signal. FIG. 3 is a graph illustrating the feedback signal 46, the enable signal 34 provided from the engine control system 24 to the control unit 26, and the command signal 36 provided from the control unit 26 to the driver circuit 30 when the corona event includes one occurrence of the arc formation. FIG. 4 is a graph illustrating the feedback signal 46, enable signal 34, and command signal 36 when multiple arc formations are detected during a single corona event.

In addition to shutting off the energy provided to the corona igniter 20 in response to the arc formation, the control unit 26 uses the information about the arc formation to adjust the energy provided to the corona igniter 20 during the same corona event, in order to achieve the maximum volume and duration of the corona discharge 22 later on during the same corona event. For example, the control unit 26 can use the information to determine whether the energy should be increased or decreased. In other words, the control unit 26 uses the information about the arc formation to control the energy provided to the corona igniter 20 on an intra-event basis.

After the duration of time wherein no energy is provided to the corona igniter 20 and the arc formation dissipates, the control unit 26 again instructs the driver circuit 30 to provide energy to the corona igniter 20. However, this time, the control unit 26 instructs the power supply 28 to adjust the energy provided to the driver circuit 30, based on the information about the arc formation, and reduce the likelihood of an occurrence of an arc formation, at least until the very end of the corona event. In other words, in order to enhance the size and/or duration of the corona discharge 22, the control unit 26 conveys the power control signal 38 to the power supply 28 instructing the power supply 28 to adjust the energy provided to the driver circuit 30 and ultimately to the corona igniter 20 during the same corona event, i.e. intra-event, based on the information about the arc formation. The control unit 26 can also adjust the timing of the command signal 36 to the driver circuit 30, in order to adjust the duration of time during which the driver circuit 30 provides energy to the corona igniter 20.

Figure 6:
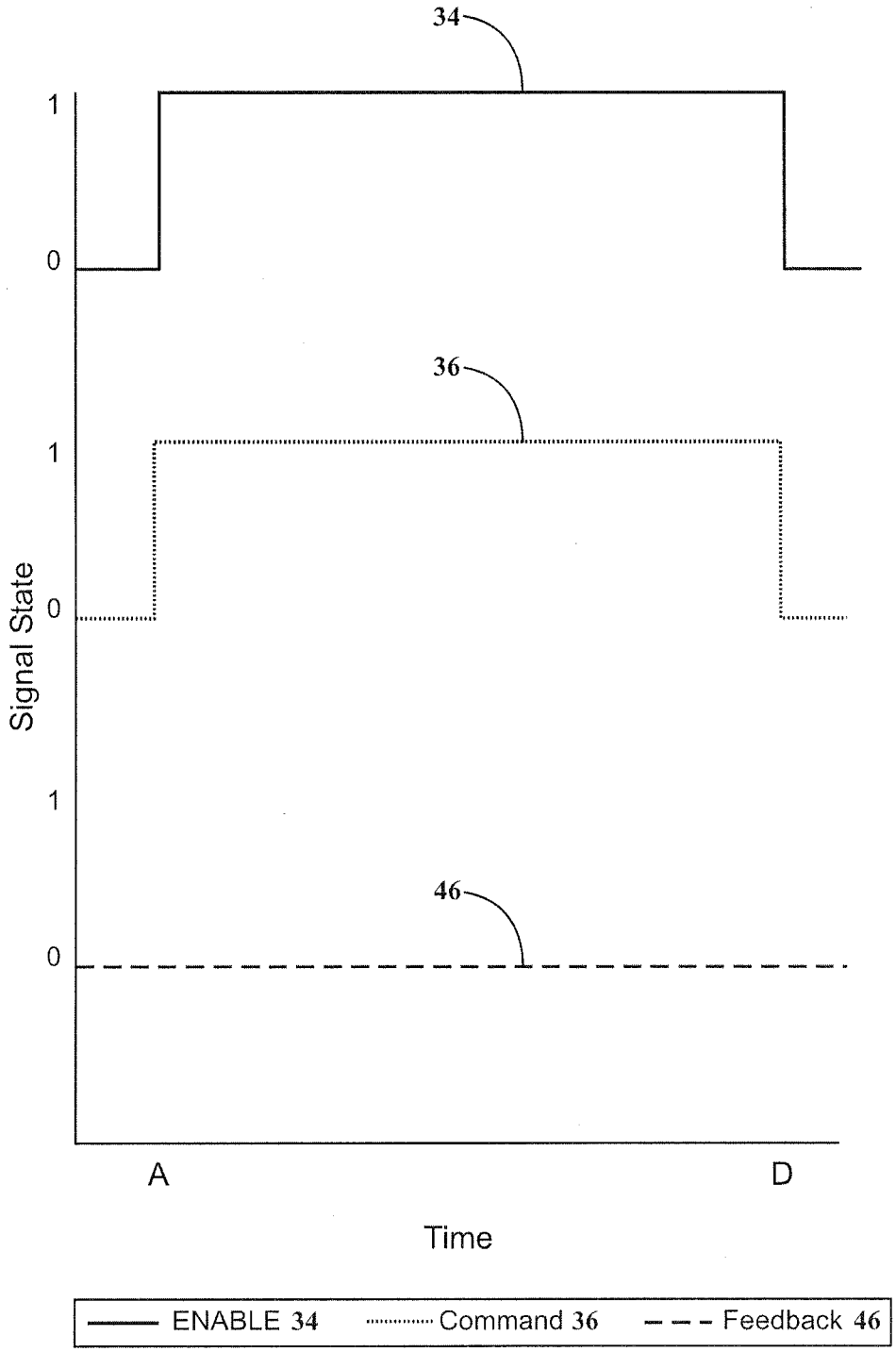
FIG. 6 is a graph illustrating a feedback signal, an enable signal, and a command signal when no arc formation is detected in a corona event.

Typically, the control unit 26 adjusts at least one of the voltage level, the current level, the total duration of the corona event, and the duration of time wherein no energy is provided to the corona igniter 20 in order to improve the quality of the corona discharge 22. If the feedback signal 46 to the control unit 26 indicates multiple arc formations occurred early in the corona event, and repeated throughout the corona event, for example traces 1-3 of FIG. 2 and FIG. 4, then the control unit 26 infers that the voltage level provided to the corona igniter 20 is too high and should be reduced during the corona event. Alternatively, the total duration of the corona event or the duration of time wherein no energy is provided to the corona igniter 20 could be increased. If the feedback signal 46 to the control unit 26 indicates that a single arc formation occurred at the beginning of the corona event, for example trace 4 of FIG. 2, then the control unit 26 again infers that the voltage level provided to the corona igniter 20 is too high and should be reduced during the corona event. Alternatively, the duration of time wherein no energy is provided to the corona igniter 20 could be increased. If the feedback signal 46 indicates no occurrence of the arc formation, for example trace 9 of FIG. 2 or FIG. 6, then the control unit 26 infers that the voltage level provided to the corona igniter 20 is too low and should be increased in order to increase the volume of corona discharge 22 during the corona event.

Figure 5:
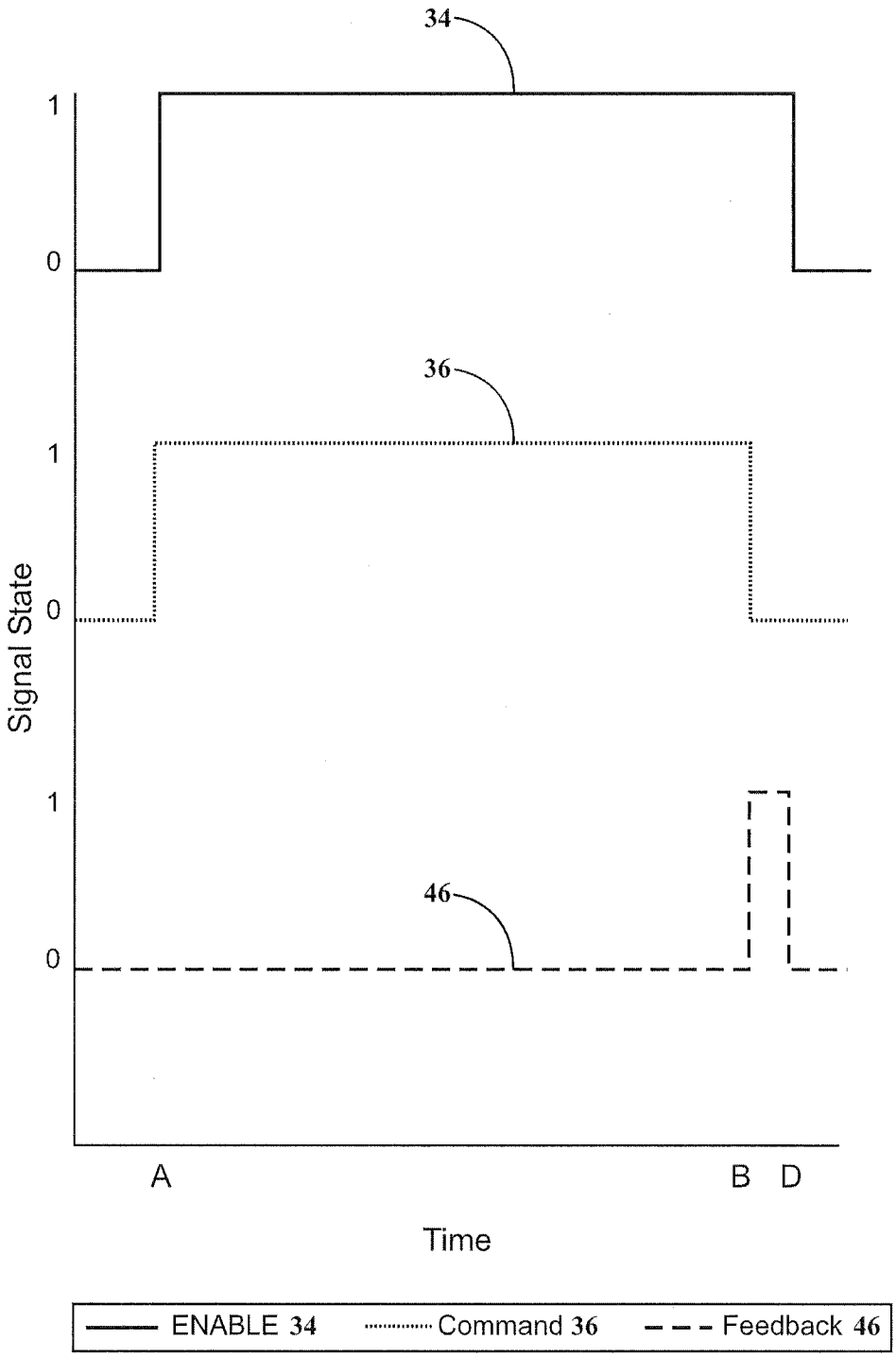
FIG. 5 is a graph illustrating a feedback signal, an enable signal, and a command signal for an ideal situation wherein only one occurrence of an arc formation is detected at the end of a corona event.

In cases where the first occurrence of an arc formation is at the very end of the corona event, for example traces 5-8 of FIG. 2 and FIG. 5, then the control unit 26 infers that the voltage level provided to the corona igniter 20 is in the correct range. In one preferred embodiment, the energy is provided to the corona igniter 20 is at a voltage level and current level causing the corona igniter 20 to provide corona discharge 22 immediately after the start time and continuously for a majority of the duration of the corona event and causing the corona igniter 20 to provide only one occurrence of the arc formation following the corona discharge 22 before the stop time of the corona event. In this case, the command signal 36 instructing the driver circuit 30 to shut off the energy provided to the corona igniter 20 in response to the arc formation may be cut off by the enable signal 34 ending the corona event. In other words, the arc formation occurs immediately prior to a predetermined stop time of the corona event. Trace 8 of FIG. 2 and FIG. 5 illustrate the feedback signal 46 during this ideal situation. In this case, the control unit 26 infers that the corona discharge 22 is at or very close to the maximum possible volume and therefore no adjustments to the energy provided to the corona igniter 20 are needed.

Figure 7:
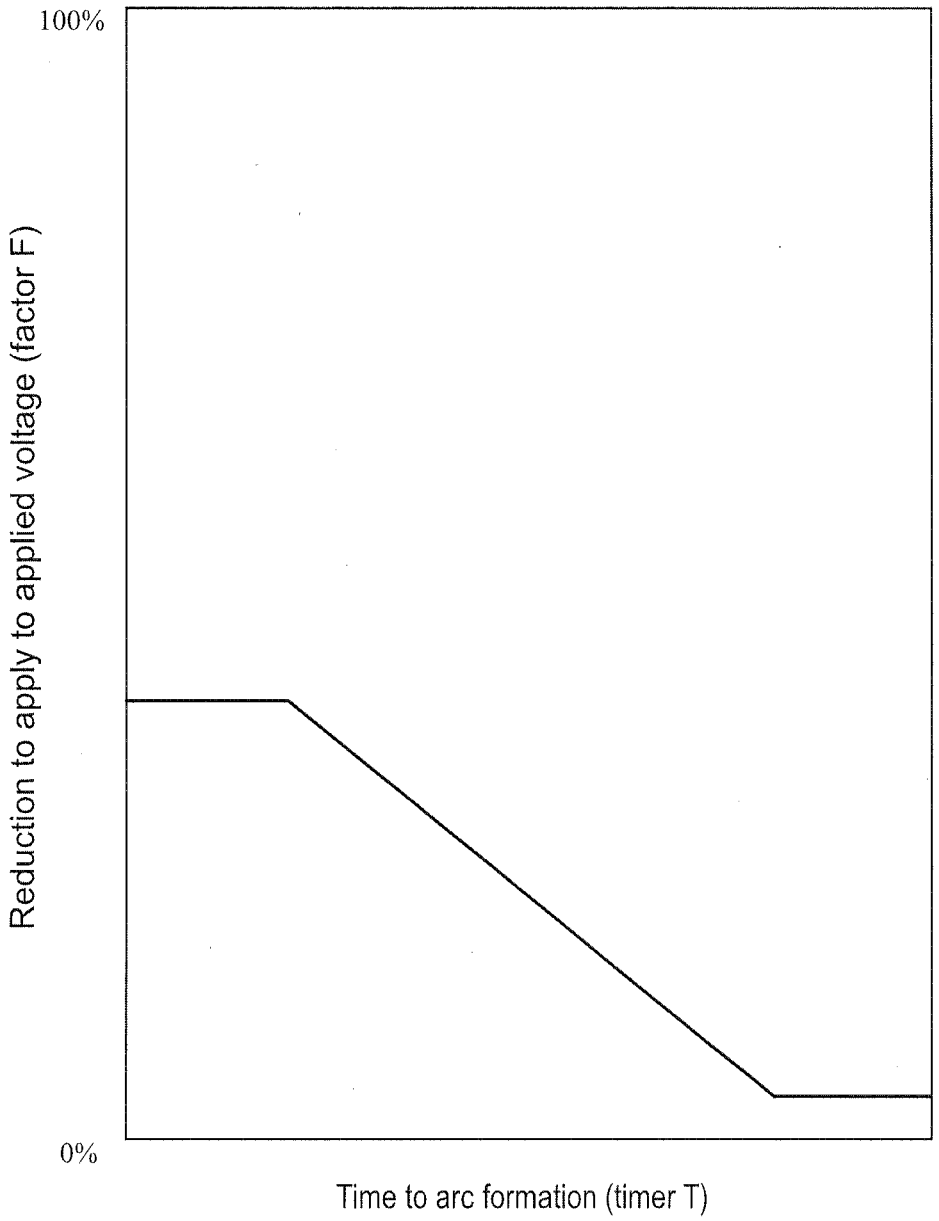
FIG. 7 is a graph illustrating a reduction factor for applying to a voltage level relative to timing of the first occurrence of an arc formation.

Typically, at least one of the voltage level and the current level are adjusted by a factor depending on the information about the arc formation. For example, if the arc formation is detected at or close to the start time of the corona event, or if the duration between consecutive occurrences of the arc formation is short, then the voltage level is reduced by a larger factor than if the arc formation is detected toward the end of the corona event or if only one arc formation is detected. FIG. 7 is a graph illustrating a reduction factor to apply to the voltage level relative to the timing of the first occurrence of an arc formation. If the arc formation is detected in the first half of the corona event, then the factor is greater than if the arc formation is detected in the latter half of the corona event. For cases where there are multiple arc formations in the single corona event, the modifications to the voltage level are cumulative. In each case, the voltage level, current level, and durations may be subject to defined limits depending on the specific system and operating conditions. In one embodiment, both the voltage level and the current level are adjusted by a factor, and the factor can be the same or different for the voltage level and the current level.

In response to the information about the arc formation, the method can also include adjusting the duration of time wherein no energy is provided to the corona igniter 20 by a factor based on the information about the arc formation. This factor can be the same or different from the factors used to adjust the voltage and current levels. For example, if the first occurrence of the arc formation is very close to the start time, or if the successive arc formations are very close together, then the duration of time wherein no energy is provided to the corona igniter 20 is increased by a larger factor.

As stated above, after the duration of time wherein no energy is provided to the corona igniter 20, the method includes providing the adjusted energy to the corona igniter 20 to form a stronger corona discharge 22 and limit the arc formation during the same corona event. If another occurrence of arc formation is detected, the control unit 26 again ceases the energy provided to the corona igniter 20 and adjusts the energy subsequently provided to the corona igniter 20 during the same corona event, i.e. intra-event control.

The system and method of the present invention can optionally include control on an inter-event basis. In this embodiment, after the stop time indicating the end of the corona event, at least one of the predetermined voltage level and the predetermined current level stored in the control unit 26 are adjusted. The predetermined voltage level and/or current level is adjusted based on at least one of: timing of an occurrence of arc formation relative to the start time of the corona event, duration between two consecutive occurrences of arc formations, number of occurrences of arc formation over a period of time during the corona event, timing of an occurrence of the arc formation relative to the stop time of the corona event, total number of occurrences of arc formation, and at least one of the voltage level and the current level provided to the corona igniter 20 at the stop time of the corona event. This adjusted voltage level and/or adjusted current level is then stored in the control unit 26, and used in a future corona event to obtain a stronger corona discharge 22 and limit arc formations. In other words, in a future corona event, the control unit 26 instructs the power supply 28 to provide the energy ultimately to the corona igniter 20 at the adjusted voltage level and/or the adjusted current level.

In another embodiment, after the end of corona event, the predetermined shut off time in response to a detected arc formation is adjusted. Thus, in a future corona event, the control circuit instructs the driver circuit 30 to cease energy provided to the corona igniter 20 for this adjusted duration of time, in order to enhance the quality of the corona discharge 22. The total duration of a future corona event could also be adjusted based on the information about the arc formation of a prior corona event, in order to enhance the quality of the corona discharge 22 in the future event.

Figure 8:
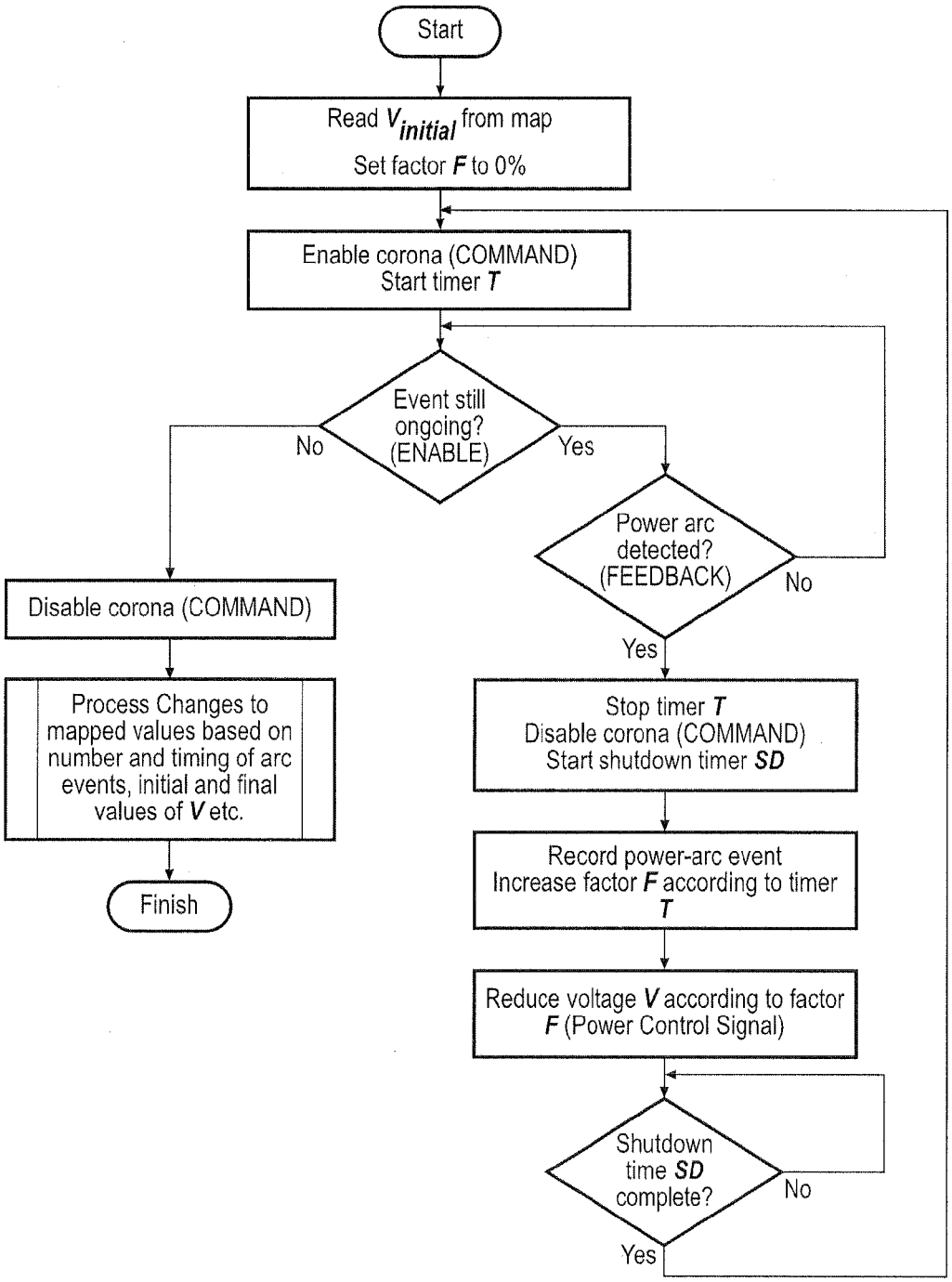
FIG. 8 is a flowchart illustrating a simplified example of an intra-event voltage control method and optional inter-event control method according to one embodiment of the invention.

FIG. 8 is a flow chart illustrating a simplified example of the corona ignition system of the present invention, including the intra-event control and optional inter-event control. When the corona event starts, a predetermined voltage level is set. This voltage level is usually read from a table or map of values stored in the control unit 26 or engine control system 24. The predetermined voltage level depends on operating conditions in the combustion chamber 32. In addition, a voltage reduction factor is set to zero, i.e. the voltage level has not yet been reduced.

The control unit 26 sends a command signal 36 to the driver circuit 30 to enable the corona discharge 22, and a timer is started. The timer measures the duration of the active corona discharge 22 before an arc formation is detected. The timer stops when the corona discharge 22 ends, in which case the enable signal 34 from the engine control system 24 ends the corona event, or when arc formation is detected, in which case a feedback signal 46 is transmitted to the control unit 26.

In the system FIG. 8, detection of an arc formation causes an interruption of the energy provided to the corona igniter 20 for a controlled period time, referred to as the shutdown time; and also causes a reduction in the applied voltage level dependent on the duration of corona discharge 22 before arc formation. In addition, information about the number and proximity of any arc formations during the corona event are provided to the control unit 26.

The timer is stopped upon detection of the arc formation, and thus provides the duration of corona discharge 22 before arc formation. The driver circuit 30 is also turned off using the command signal 36, such that the energy applied to the corona igniter 20 is turned off, and timing of this shutdown begins, referred to as timer shutdown. The duration of the shutdown may be fixed, may be taken from a map depending on operating conditions, or may be adapted according to the arc formations previously detected. The arc formations are recorded for feedback and diagnostic purposes and the factor is modified according to a suitable function, for example as shown in FIG. 7. The function, however, can vary from that shown in FIG. 7, and different function can be used for different arc formations in the same corona event. In addition, the function used to control the factor against time may be different from that used to control the factor against voltage or against current.

The control signal to the power supply 28 instructs the power supply 28 to provide a voltage level reduced according to the factor, subject to externally-set minimum and maximum limits. This reduces the voltage level applied to the corona igniter 20 and hence lowers the voltage obtained at the igniter tip 40 when the driver circuit 30 is re-energized. When the shutdown timer completes, the corona igniter 20 is re-enabled and operation of the corona igniter 20 continues. The enable signal 34 eventually causes the corona discharge 22 to shut off and optional inter-event processing can take place, as shown in the left branch of FIG. 8.

Figure 9:
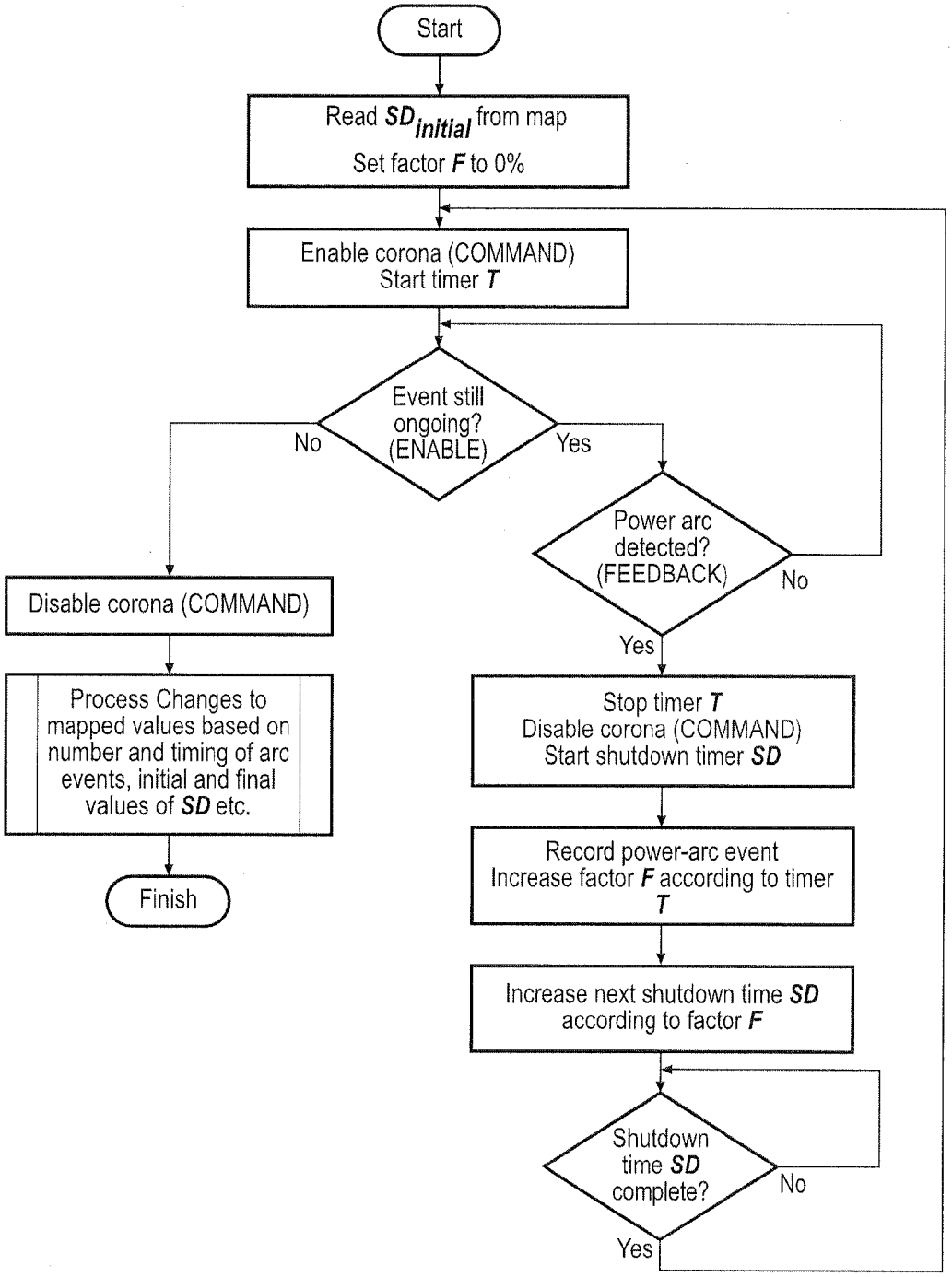
FIG. 9 is a flowchart illustrating another simplified example of an intra-event shutdown control method and optional inter-event control method according to another embodiment of the invention.

FIG. 9 is a flow chart illustrating another simplified example of the corona ignition system of the present invention, including the intra-event and optional inter-event control. FIG. 9 shows how a similar control strategy may be applied to optimize the shutdown time used to interrupt the corona igniter 20 once the arc formation is detected, in order to allow the arc formation to dissipate and corona discharge 22 to be resumed. The logic of the system is identical to the system of FIG. 8 for voltage control, but in this case, the factor is used to increase the shutdown time. Control of the shutdown time, applied voltage, or of both at the same time, may be applied to optimize the corona discharge 22 on an intra-event timescale.

After the corona event, the final values of voltage level, current level, and/or shutdown time, as well as the recorded number and timing of arc formations detected, are provided to the control unit 26 through the feedback signal 46 and to the engine control system 24 through a feedback interface 48. This data may optionally be processed and used to modify the starting values used in the next corona event, as shown in the left branch of FIGS. 8 and 9. Thus, the control unit 26 or engine control system 24 can attempt to produce the optimum pattern of corona discharge 22 and arc formation, such as the pattern shown in FIG. 5. If the voltage level and duration is not reduced during the corona event, this means that no arc formation was detected. Thus, the voltage in the next corona event should be increased in order to favor achievement of the ideal pattern. If the voltage level and/or duration have been greatly reduced, then the voltage level in the next corona event should be reduced to reduce the amount of arc formation. All modifications to voltage level, current level, and duration should be limited by externally defined minima and maxima, which are set depending on the engine and igniter geometry, engine operating conditions, etc.

Obviously, many modifications and variations of the present invention are possible in light of the above teachings and may be practiced otherwise than as specifically described while within the scope of the appended claims.

What is claimed is:

1. A method of controlling a corona ignition system, comprising the steps of:

providing energy to a corona igniter during a corona event, wherein the energy is at a voltage level and a current level, and the corona event includes a single continuous duration of time extending from a start time to a stop time;

providing no energy to the corona igniter for a duration of time immediately after any occurrence of an arc formation;

obtaining information about the at least one occurrence of the arc formation, the information including at least one of: timing of at least one occurrence of the arc formation relative to the start time of the corona event, duration between two consecutive occurrences of the arc formations, and number of occurrences of the arc formation over a period of time during the corona event;

adjusting at least one of the voltage level, the current level, the stop time of the corona event, and the duration of time wherein no energy is provided to the corona igniter based on the information about the arc formation, and the adjusting step occurring during the corona event and further comprising:

conveying an activation command signal from a control unit to a driver circuit to activate the driver circuit;

conveying a first power control signal from the control unit to a power supply in response to an enable signal;

conveying power from the power supply to the driver circuit in response to the first power control signal;

conveying the energy from the driver circuit to the corona igniter in response to the activation command signal so that the corona igniter provides corona discharge;

detecting any occurrence of the arc formation using the driver circuit;

the step of obtaining the information about the arc formation being conducted by the driver circuit;

conveying a feedback signal from the driver circuit to the control unit during the corona event, wherein the feedback signal indicates the occurrence of the arc formation and includes the information about the arc formation;

conveying an energy command signal from the control unit to the driver circuit instructing the driver circuit to provide no energy to the corona igniter for the duration of time in response to the feedback signal;

conveying a second power control signal from the control unit to the power supply instructing the power supply to adjust the voltage level provided to the driver circuit based on the information about the arc formation in response to the feedback signal; and conveying the energy at the adjusted voltage level from the driver circuit to the corona igniter after the duration of time wherein no energy is provided to the corona igniter to resume the corona discharge before the stop time of the corona event.

2. The method of claim 1 including initiating the corona event at the start time by conveying the enable signal from an engine control system to the control unit; and the step of conveying the energy command signal from the control unit to the driver circuit to activate the driver circuit being in response to the enable signal.

3. A method of controlling a corona ignition system, comprising the steps of:

providing energy to a corona igniter during a corona event, wherein the energy is at a voltage level and a current level, and the corona event includes a single continuous duration of time extending from a start time to a stop time;

providing no energy to the corona igniter for a duration of time immediately after any occurrence of an arc formation;

obtaining information about the at least one occurrence of the arc formation, the information including at least one of: timing of at least one occurrence of the arc formation relative to the start time of the corona event, duration between two consecutive occurrences of the arc formations, and number of occurrences of the arc formation over a period of time during the corona event;

adjusting at least one of the voltage level, the current level, the stop time of the corona event, and the duration of time wherein no energy is provided to the corona igniter based on the information about the arc formation, and the adjusting step occurring during the corona event; and wherein the voltage level provided to the corona igniter at the start time is predetermined, and further comprising adjusting the predetermined voltage level after the corona event based on at least one of: timing of an occurrence of arc formation relative to the start time of the corona event, duration between two consecutive occurrences of arc formations, number of occurrences of arc formation over a period of time during the corona event, timing of an occurrence of the arc formation relative to the stop time of the corona event, total number of occurrences of arc formation, and the voltage level provided to the corona igniter at the stop time of the corona event; and providing the adjusted voltage level to the corona igniter in a future corona event.

4. The method of claim 3 including detecting any occurrence of an arc formation from the corona igniter during the corona event.

5. The method of claim 4 wherein the step of detecting any occurrence of an arc formation includes identifying a variation in an oscillation period of the resonant frequency of the corona igniter.

6. The method of claim 3 including the steps of: providing the corona discharge continuously for the majority of the duration of the corona event; and providing only one occurrence of the arc formation, and the one occurrence being immediately before a predetermined stop time of the corona event.

7. The method of claim 3 wherein the adjusting step which occurs during the corona event includes reducing at least one of the voltage level and the current level during the corona event by a factor based on the information about the arc formation.

8. The method of claim 3 wherein the adjusting step which occurs during the corona event includes adjusting the duration of time wherein no energy is provided to the corona igniter by a factor based on the information about the arc formation.

9. The method of claim 3 wherein the corona igniter emits a corona discharge prior to a first occurrence of the arc formation; the step of providing no energy to the corona igniter includes dissipating the arc formation; and providing energy to the corona igniter to resume the corona discharge immediately after the duration of time wherein no energy is provided to the corona igniter.

10. The method of claim 3 including increasing at least one of the size and the duration of the corona discharge during the corona event as a result of the adjusting step which occurs during the corona event.

* * * * *